United States Patent [19]

Coleman

[11] 4,066,191

[45] Jan. 3, 1978

[54] DRINKING AND POURING SPOUT FOR USE WITH EASY-OPENING CONTAINERS

[76] Inventor: Kenneth L. Coleman, 715 W. Gordon Terrace, Chicago, Ill. 60613

[21] Appl. No.: 733,448

[22] Filed: Oct. 18, 1976

[51] Int. Cl.[2] ..... B65D 5/74; B65D 25/00; A47G 19/22

[52] U.S. Cl. ..... 222/569; 220/85 SP; 220/90.2; 220/243

[58] Field of Search ..... 220/90.2, 90.4, 90.6, 220/243, 307, 85 SP; 222/519, 566, 567, 569, 542

[56] References Cited

U.S. PATENT DOCUMENTS

| | | | |
|---|---|---|---|
| 2,727,659 | 12/1955 | Nyden | 220/85 SP |
| 3,672,547 | 6/1972 | Kozlowski | 220/85 SP X |
| 3,727,787 | 4/1973 | Gregory | 220/243 |

*Primary Examiner*—William Price
*Assistant Examiner*—Steven M. Pollard
*Attorney, Agent, or Firm*—Allegretti, Newitt, Witcoff & McAndrews

[57] ABSTRACT

A pouring and drinking spout adapted for sealed engagement with the mouth of a variety of containers of the easy-opening, pull-tab type. The spout is preferably molded to form a hollow, barrel-shaped spout portion which is enlarged at one end to form a ring-shaped flange or lip, defining a circular bearing surface to which a resilient washer is attached. A flared camming member aligned with the axis of the spout engages with the inner edges of the mouth of the container as the spout is manually rotated, clamping the washer between the container and the circular bearing surface of the spout, forming a seal. A stop lug, spaced radially outward from the axis of the barrel, engages with the inner edge of the container mouth to prevent further rotation when the spout is in its locked position. A deformable cap is pressed over the mouth of the spout to re-seal the container.

5 Claims, 8 Drawing Figures

Fig. 1
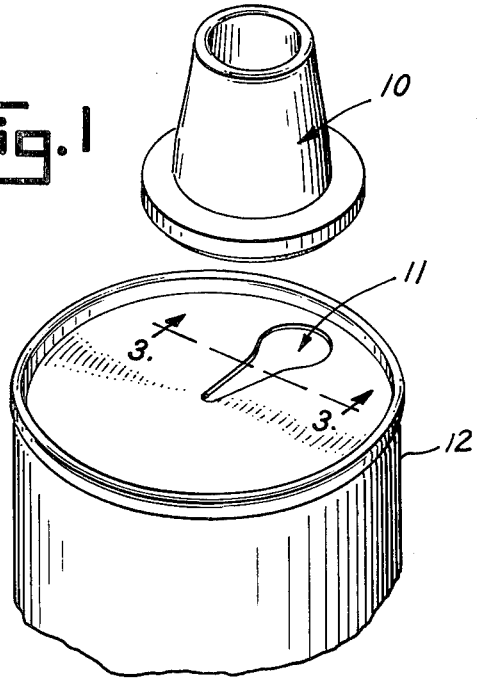
Fig. 2
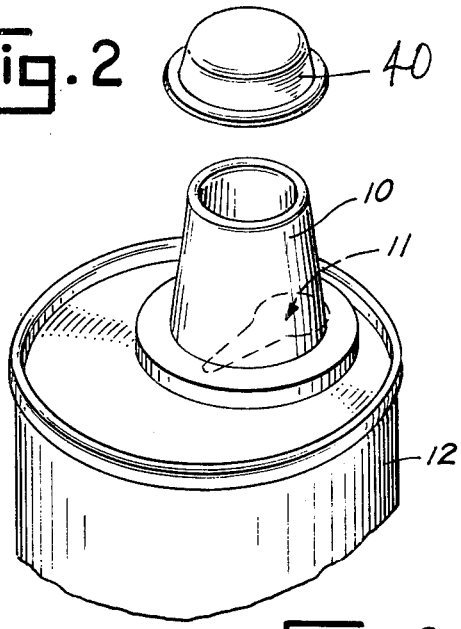
Fig. 8
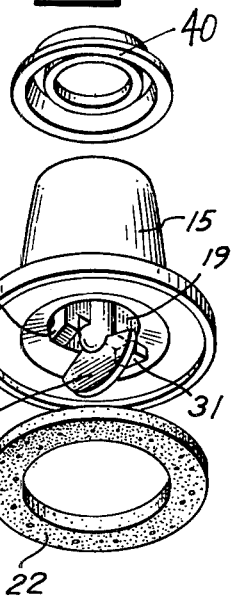
Fig. 5
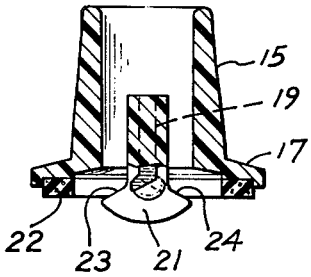
Fig. 3
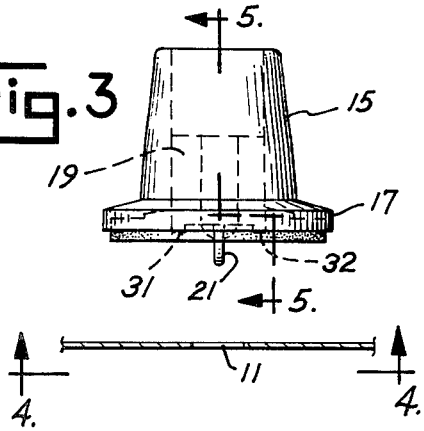
Fig. 4
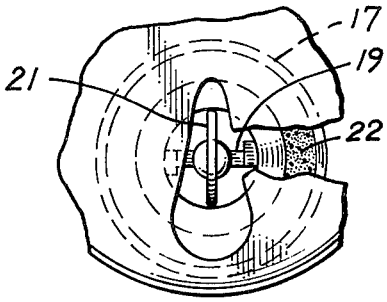
Fig. 6
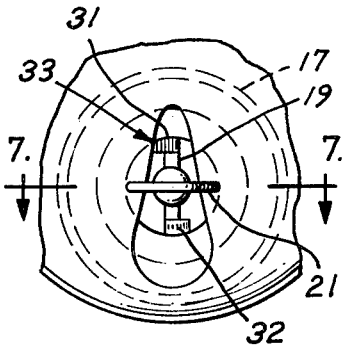
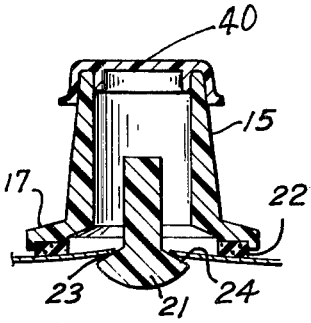
Fig. 7

DRINKING AND POURING SPOUT FOR USE WITH EASY-OPENING CONTAINERS

SUMMARY OF THE INVENTION

This invention relates generally, although in its broader aspects not exclusively, to a drinking spout for use with beverage containers of the easy-opening pull-tab or tear-top variety.

It is an object of the present invention to provide a safer, more comfortable, and cleaner way to drink beverages directly from an easy-opening can.

The so-called "easy-opening" can is now in widespread use. The need for a separate can opener is eliminated by providing the can with a frangible wall portion which can be removed from the remainder of the can by manually gripping a pull-tab or the like and separating the removable portion along lines of weakness in the container wall.

Although metallic containers of the pull-tab type are indeed convenient and enjoy great popularity, particularly as beverage containers, they have disadvantages. Once opened, the container cannot be re-sealed to protect the beverage against contamination, spillage or evaporation. Also, the edges of the mouth of the can which are formed when the frangible section is torn away can be uncomfortably sharp. More seriously, consumers often fail to properly dispose of the removable pull-tab element and instead drop it into the can and then later swallow the element when the beverage is consumed. Finally, although the beverage sealed within the can is itself presumably clean and wholesome, the exterior surfaces of the can which are brought to the mouth may have been contaminated. The present invention eliminates or greatly reduces all of these common hazards and disadvantages.

In a principal aspect, the present invention takes the form of a drinking spout which is easily locked into sealed engagement over the mouth of the container and which presents a smooth, clean and comfortable drinking surface to the lips, blocks the passage of the pull-tab element if it has been dropped into the can, and isolates the potentially sharp edges of the can from contact.

The spout comprises a hollow, substantially cylindrical barrel portion which defines a ring-shaped bearing surface at one end to which a deformable sealing washer is attached. An axially aligned camming member engages with the inner edges of the mouth of the container as the spout is rotated, locking the spout in position and clamping the washer in sealed engagement with the container's surface. A stop lug spaced radially outward from the axis of the spout prevents further rotation of the spout after it reaches its fully locked position.

BRIEF DESCRIPTION OF THE DRAWING

These and other objects, features and advantages of the invention will become more apparent through a consideration of the following detailed description of the preferred embodiment of the invention. In the course of this description, reference will frequently be made to the attached drawing, in which:

FIGS. 1 and 2 are perspective views which show the spout respectively separated from and locked to the mouth of a typical easy-opening container;

FIG. 3 is a side view of the spout and container mouth taken along the line 3—3 of FIG. 1;

FIG. 4 is a bottom view of the spout and container mouth taken along the line 4—4 of FIG. 3;

FIG. 5 is a side, cross-sectional view of the spout taken along the line 5—5 of FIG. 3;

FIG. 6 is a bottom view of the container mouth showing the engagement of the rotation-limiting lugs with the inner edges of the mouth;

FIG. 7 is a side cross-sectional view taken along the line 7—7 of FIG. 6; and FIG. 8 is an exploded perspective view of the underside of the spout with the sealing washer shown separately.

DESCRIPTION OF THE PREFERRED EMBODIMENT

FIG. 1 depicts a drinking and pouring spout 10 of the type contemplated by the invention shown spaced from the mouth 11 of conventional beverage container 12. The teardrop-shaped mouth 11 is formed when the frangible pull-tab element (not shown) is torn from the container 12. FIG. 2 shows the spout 10 in its locked position over the mouth 11.

As seen in FIGS. 3 through 8 of the drawing, the spout 10 comprises a hollow, substantially cylindrical barrel portion 15 contoured to fit the mouth comfortably with no sharp edges and enlarged at its lower end to form a ring-shaped flange 17. A cross-web 19 extends diametrically across the passageway through the barrel 15 to support an axially aligned camming member 21.

As best seen in FIG. 8, the underside of the ring-shaped flange 17 is recessed to receive a resilient, deformable washer 22. Washer 22 can be inexpensively die cut from polyethylene foam material and seals against leakage between the spout and container top, even if the can top surface has an embossed or otherwise irregular surface.

The camming member 21 is flared at its lower end to present two inclined, radially-extending, bearing surfaces or ramps 23 and 24 as shown in FIG. 5. To lock the spout in position on the can top, it is merely necessary to insert the camming member into the mouth of the container and to then rotate the spout approximately one-quarter turn. The position of the camming member 21, with respect to the mouth opening, both before and after rotation is shown respectively in FIGS. 4 and 6. As best shown in FIG. 6, as the spout is rotated, the inclined camming surfaces engage with the inner edges of the container mouth, pulling the spout downwardly onto the can top and clamping the washer 22 in sealed engagement between the ring-shaped bearing surface provided by the recessed circular flange 17 and the surface of the can top. Further, the can top itself, being normally constructed of resilient metallic sheet material is also deflected as seen in FIG. 7.

A pair of opposing stop lugs 31 and 32 are spaced radially outward from the axis of the spout and project axially to a point slightly beyond the outer plane of the flange 17. As the spout is being rotated toward its fully engaged position, the stop-lugs 31 or 32 drop into the mouth of the can. When the spout is fully clamped to the can, one of the stop lugs abuts against the inner edge of the mouth (at the point indicated at 33 in FIG. 6), thereby preventing further rotation. The frictional engagement between the washer 22 and the top surface of the container prevents undesired return rotation of the spout to an unlocked position.

As clearly seen in FIG. 5, the passageway through the spout is enlarged adjacent the flange 17 to permit a venting airflow through that portion of the container mouth well-spaced from the container rim. On the other hand, contaminants which may accumulate in the recesses of the container adjacent its rim are completely sealed from the fluid passageway.

The entire spout (exclusive of the sealing washer 22) can be readily and inexpensively molded from a suitable material such as polypropelene by injection molding. The twist-lock feature of the spout allows it to be securely attached to the container with a single twist, and removed for re-use later with a single reverse twist.

As seen in FIGS. 2, 7 and 8, the mouth of the spout 10 may be closed with a cap indicated generally at 40. The cap 40 is made of an elastic, deformable material, such as molded or cast polyethylene, and is pressed in place over the rim of the spout's mouth as shown in FIG. 7.

The combination of the spout 10 and the cap 40 forms a sealed closure for a previously opened container. The spout, when capped, seals the contents of the container against contamination and prevents spillage and evaporation.

It is to be understood that the specific drinking spout arrangement which has been described is merely illustrative of one application of the principles of the invention. Numerous modifications may be made by those skilled in the art without departing from the true spirit and scope of the invention.

What is claimed is:

1. A pouring and drinking spout adapted for sealed engagement with the mouth of an easy-opening container comprising, in combination, a substantially cylindrical, hollow barrel defining a ring-shaped bearing surface at one end thereof, a resilient sealing washer attached to said bearing surface, and a flared camming member supported at the axis of said barrel outwardly of said bearing surface for engaging with the interior edges of the mouth of said container as said barrel is turned with respect thereto to hold said sealing washer in sealed engagement with the surface of said container.

2. The spout set forth in claim 1 including at least one rotation-limiting projection positioned radially outward from said axis and extending axially beyond the plane of said bearing surface to engage with the interior edge of said mouth when said spout is rotated into a position of engagement with said container.

3. A spout adapted for attachment to an opening in a substantially flat surface of a liquid container comprising, in combination, a substantially cylindrical, hollow barrel member defining a fluid passageway therethrough and defining a ring-shaped bearing surface at one end thereof, a deformable sealing washer attached to said bearing surface, and a camming member rigidly supported substantially at the axis of said barrel member and defining two radially extending, inclined ramp surfaces positioned to engage with the inner edges of the mouth of said container as said barrel member is rotated to clamp said sealing washer between said ring-shaped bearing surface and the surface of said container.

4. A spout as set forth in claim 3 including at least one stop lug positioned radially outward from the axis of said barrel member and extending axially beyond the plane of said bearing surface to engage with the inner edge of said mouth to prevent continued rotation of said barrel member with respect to said container.

5. A spout as set forth in claim 3 including a cap shaped to conform to and close that end of said barrel member opposed to said bearing surface.

* * * * *